US009745811B2

(12) United States Patent
Wesemeier et al.

(10) Patent No.: US 9,745,811 B2
(45) Date of Patent: Aug. 29, 2017

(54) ACTIVATION MODULES FOR OBSTRUCTING ENTRANCES TO INNER BARRELS OF CORING TOOLS AND RELATED CORING TOOLS AND METHODS

(71) Applicant: Baker Hughes Incorporated, Houston, TX (US)

(72) Inventors: Christoph Wesemeier, Hannover (DE); Thomas Uhlenberg, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 442 days.

(21) Appl. No.: 14/469,296

(22) Filed: Aug. 26, 2014

(65) Prior Publication Data

US 2016/0060986 A1 Mar. 3, 2016

(51) Int. Cl.

| | |
|---|---|
| ***E21B 25/00*** | (2006.01) |
| ***E21B 7/00*** | (2006.01) |
| ***E21B 10/02*** | (2006.01) |
| ***E21B 33/10*** | (2006.01) |
| ***E21B 25/10*** | (2006.01) |
| ***E21B 49/02*** | (2006.01) |

(52) U.S. Cl.
CPC ..... *E21B 25/00* (2013.01); *E21B 10/02* (2013.01); *E21B 49/02* (2013.01)

(58) Field of Classification Search
CPC ..... E21B 10/02; E21B 49/02; E21B 25/00
See application file for complete search history.

(56) References Cited

U.S. PATENT DOCUMENTS

| | | | | |
|---|---|---|---|---|
| 6,719,070 | B1 | 4/2004 | Puymbroeck et al. | |
| 7,004,265 | B2 * | 2/2006 | Van Puymbroeck ... | E21B 25/06 175/20 |
| 7,093,676 | B2 * | 8/2006 | Puymbroeck ..... | E21B 25/06 175/226 |
| 7,231,991 | B2 * | 6/2007 | Van Puymbroeck ... | E21B 25/06 175/250 |

(Continued)

FOREIGN PATENT DOCUMENTS

WO 2014123506 A2 8/2014

OTHER PUBLICATIONS

Wesemeier et al., U.S. Appl. No. 61/847,915, filed Jul. 18, 2013, for Pressure Compensation Modules for Coring Tools, Coring Tools Including Pressure Compensation Modules, and Related Methods.

(Continued)

*Primary Examiner* — Nicole Coy
(74) *Attorney, Agent, or Firm* — TraskBritt

(57) ABSTRACT

Activation modules for selectively sealing entrances to inner barrels of coring tools may include an activator body sized and configured to obstruct the entrance to the inner barrel when the activation module is in a first state and to release the entrance to the inner barrel when the activation module is in a second state. A sealing element may be located at a periphery of the activator body, and may be configured to form a seal between at least a portion of an interior of the inner barrel and at least a portion of an exterior of the inner barrel when the activation module is in the first state and to disengage the seal when the activation module is in the second state.

14 Claims, 5 Drawing Sheets

(56) References Cited

U.S. PATENT DOCUMENTS

| | | | | |
|---|---|---|---|---|
| 7,234,547 | B2 * | 6/2007 | Puymbroeck | E21B 25/06 175/250 |
| 2011/0253452 | A1 | 10/2011 | Beuershausen et al. | |
| 2012/0234607 | A1 | 9/2012 | Kinsella | |
| 2013/0081878 | A1 | 4/2013 | Wilson | |

OTHER PUBLICATIONS

International Search Report for International Application No. PCT/US2015/046856 dated Nov. 23, 2015, 3 pages.
Written Opinion of the International Searching Authority for International Application No. PCT/US2015/046856 dated Nov. 23, 2015, 12 pages.

* cited by examiner

ACTIVATION MODULES FOR OBSTRUCTING ENTRANCES TO INNER BARRELS OF CORING TOOLS AND RELATED CORING TOOLS AND METHODS

FIELD

This disclosure relates generally to coring tools for procuring core samples of earth formations. More specifically, disclosed embodiments relate to coring tools that may increase the accuracy with which a core sample procured using the coring tools reflects the actual characteristics of the earth formation from which the core sample was cut.

BACKGROUND

When evaluating whether a given earth formation contains valuable materials, such as fluid hydrocarbons, a core sample of the earth formation may be procured. For example, a coring tool, which may include a coring bit configured to remove earth material around a columnar core sample, may be placed at the bottom of a borehole and rotated under load to form a core sample. As the coring tool advances, the core sample may be received into an inner barrel within the coring tool, which may be configured to contain the core sample during retrieval and reduce (e.g., minimize) contamination until the core sample can be analyzed. When the core sample is returned to the surface, the core sample, any fluids entrapped within the core sample, and any fluids that escaped the core sample but were captured by the coring tool may be analyzed to determine the characteristics exhibited by the earth formation.

To ensure that the core sample more accurately represents the actual characteristics of an earth formation at the end of a borehole, steps are taken to reduce the likelihood that contaminants enter an inner barrel that is to receive the core sample. For example, an entrance to the inner barrel may be sealed shut while advancing the coring tool into the borehole to reduce the likelihood that materials other than the core sample (e.g., drilling fluid and particles suspended within the drilling fluid) enter the inner barrel and contaminate the core sample. The entrance to the inner barrel may be sealed shut by, for example, an activation module that is intended to block the entrance to the inner barrel while the coring tool is advanced into the borehole and to unblock the entrance to the inner barrel when a core sample is introduced into the inner barrel. As a further example, the inner barrel may be substantially emptied of material and then filled, and potentially pressurized, with a presaturation fluid (i.e., a fluid of known composition that will not contaminate the core sample) before the coring tool is introduced into the borehole. The presaturation fluid may be a fluid that is not wettable to a sponge material lining the interior of the inner barrel, the sponge material being wettable to a fluid of interest expected to be found within the core sample, such as oil.

BRIEF SUMMARY

In some embodiments, activation modules for selectively sealing entrances to inner barrels of coring tools may include an activator body sized and configured to obstruct the entrance to the inner barrel when the activation module is in a first state and to release the entrance to the inner barrel when the activation module is in a second state. A sealing element may be located at a periphery of the activator body, and may be configured to form a seal between at least a portion of an interior of the inner barrel and at least a portion of an exterior of the inner barrel when the activation module is in the first state and to disengage the seal when the activation module is in the second state.

In other embodiments, coring tools may include a coring bit comprising a cutting structure configured to cut a core sample. An inner barrel may be connected to the coring bit. The inner barrel may be configured to receive a core sample within the inner barrel. An activation module may be configured to selectively seal an entrance to the inner barrel. The activation module may include an activator body sized and configured to obstruct the entrance to the inner barrel when the activation module is in a first state and to release the entrance to the inner barrel when the activation module is in a second state. A sealing element may be located at a periphery of the activator body. The sealing element may be configured to form a seal between at least a portion of an interior of the inner barrel and at least a portion of an exterior of the inner barrel when the activation module is in the first state and to disengage the seal when the activation module is in the second state.

In still other embodiments, methods of coring earth formations may involve advancing a coring tool into a wellbore. The coring tool may include an inner barrel configured to receive a core sample cut by the coring tool. The inner barrel may include a presaturation fluid. Drilling fluid may flow along an exterior of the inner barrel. The presaturation fluid may be sealed within at least a portion of the inner barrel and the drilling fluid may be sealed from intermixing with the presaturation fluid utilizing an activation module. The activation module may include a sealing element located at a periphery of an activator body of the activation module. A core sample may be cut utilizing the coring tool. The core sample may advance toward the inner barrel. Responsive to the core sample advancement, the activation module may be transferred from a first state to a second state in which the activation module is free to enter the inner barrel and the seal previously formed by the sealing element is disengaged.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

The illustrations presented herein are not meant to be actual views of any particular activation module, coring tool, or component thereof, but are merely idealized representations employed to describe illustrative embodiments. Thus, the drawings are not necessarily to scale.

Disclosed embodiments relate generally to coring tools that may not form a seal around a core sample at an entrance to an inner barrel for the core sample, enabling presaturation fluid to escape. More specifically, disclosed are embodiments of activation modules for selectively sealing entrances to inner barrels of coring tools, which activation modules may include a sealing element that forms a seal when the activation module is in a first state, disengages the seal when the activation module is in a second state, and does not engage with a core sample advancing into the inner barrel while reducing (e.g., eliminating) the risk for the disengaged seal to contact a sponge or other parts around the core to reduce (e.g., to eliminate) the risk for a core jam caused by the disengaged seal in contact with the sponge or other parts around the core.

Figure 1:
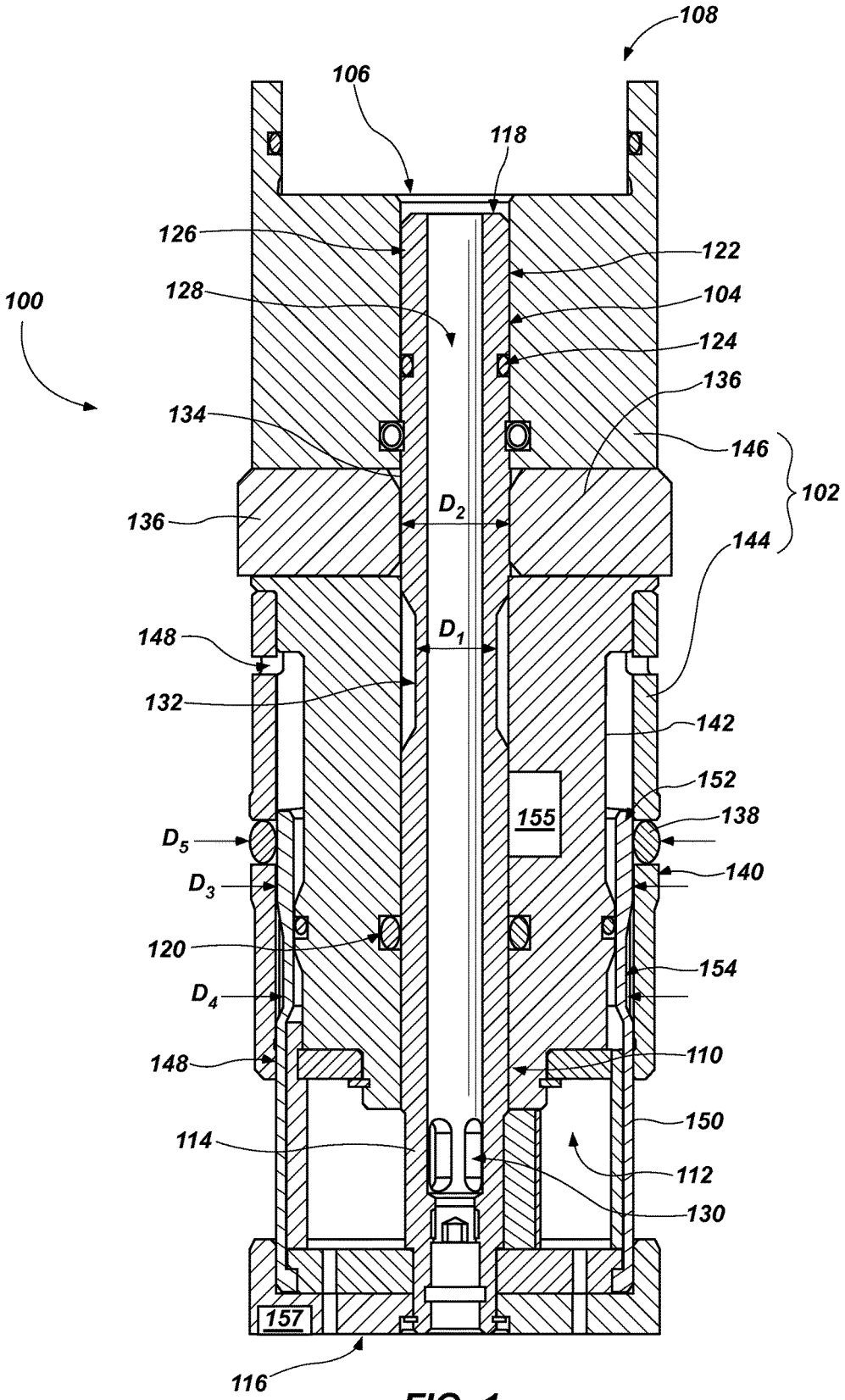
FIG. 1 is a cross-sectional side view of an activation module for a coring tool in a first state.

Referring to FIG. 1, a cross-sectional view of an activation module 100 is shown in a first state. When in the first state, the activation module 100 may be configured to obstruct an entrance 172 (see FIGS. 6, 8) to an inner barrel 166 (see FIGS. 6, 8), the inner barrel 166 (see FIGS. 6, 8) being configured to receive a core sample 200 (see FIG. 8) cut by a coring tool 156 (see FIGS. 6, 8). The activation module 100 may include an activator body 102, which may be sized and configured to obstruct the entrance 172 (see FIGS. 6, 8) to the inner barrel 166 (see FIGS. 6, 8) and may exhibit an at least substantially cylindrical shape in some embodiments. The activator body 102 may include an inner bore 104 extending through the activator body 102, including an opening 106 proximate an upper longitudinal end 108 of the activator body 102 and another opening 110 proximate a lower longitudinal end 112 of the activator body 102.

The activation module 100 may include an activation rod 114 located partially within the inner bore 104 of the activator body 102. The activation rod 114 may include a first end 116 configured to be engaged (e.g., contacted) by a core sample 200 (see FIG. 8) as it advances into a coring tool 156 (see FIGS. 6, 8) toward an inner barrel 166 (see FIGS. 6, 8) and a second, opposing end 118 proximate the upper longitudinal end 108 of the activator body 102 of the activation module 100. A sealing element 120 (e.g., an O-ring) may form a seal between the activation rod 114 and an inner surface 122 of the activator body 102 defining the inner bore 104. While the drawing shows the location of the sealing element 120 in recess of the inner surface 122 of activator body 102 it is to be understood that the sealing element could be located in a recess of an outer surface 126 of the activation rod 114 leading to the same sealing functionality between inner surface 122 of activator body 102 and outer surface 126 of the activation rod 114. In addition, or in the alternative, a sealing element 124 may be formed between the inner surface 122 of the activator body 102 and an outer surface 126 of the activation rod 114 located within the inner bore 104.

In some embodiments, the activation rod 114 may include a compensation bore 128 extending at least partially through the activation rod 114. The compensation bore 128 may be configured to provide fluid communication between the first end 116 and the second, opposing end 118 of the activation rod 114. For example, the compensation bore 128 may extend entirely through the activation rod 114 from the first end 116 to the second end 118. As another example, the activation rod 114 may include relief ports 130 providing a fluid passage from the compensation bore 128, through the outer side surface 126 of the activation rod 114, to an exterior of the activation rod 114. The relief ports 130 may be located, for example, proximate the first end 116 of the activation rod 114 and may be located outside the inner bore 104 when the activation module 100 is in the first state, as shown in FIG. 1. The compensation bore 128 may be configured to expose one side of a compensating piston 186 (see FIGS. 6, 8) of a pressure compensation module 182 (see FIGS. 6, 8) to the pressure of drilling fluid, enabling the compensation module 182 (see FIGS. 6, 8) to compensate for pressure differentials between fluid sealed within the inner barrel 166 (see FIGS. 6, 8) and fluid circulating outside the inner barrel 166 (see FIGS. 6, 8), as described in greater detail in connection with FIG. 6.

Figures 6, 7:
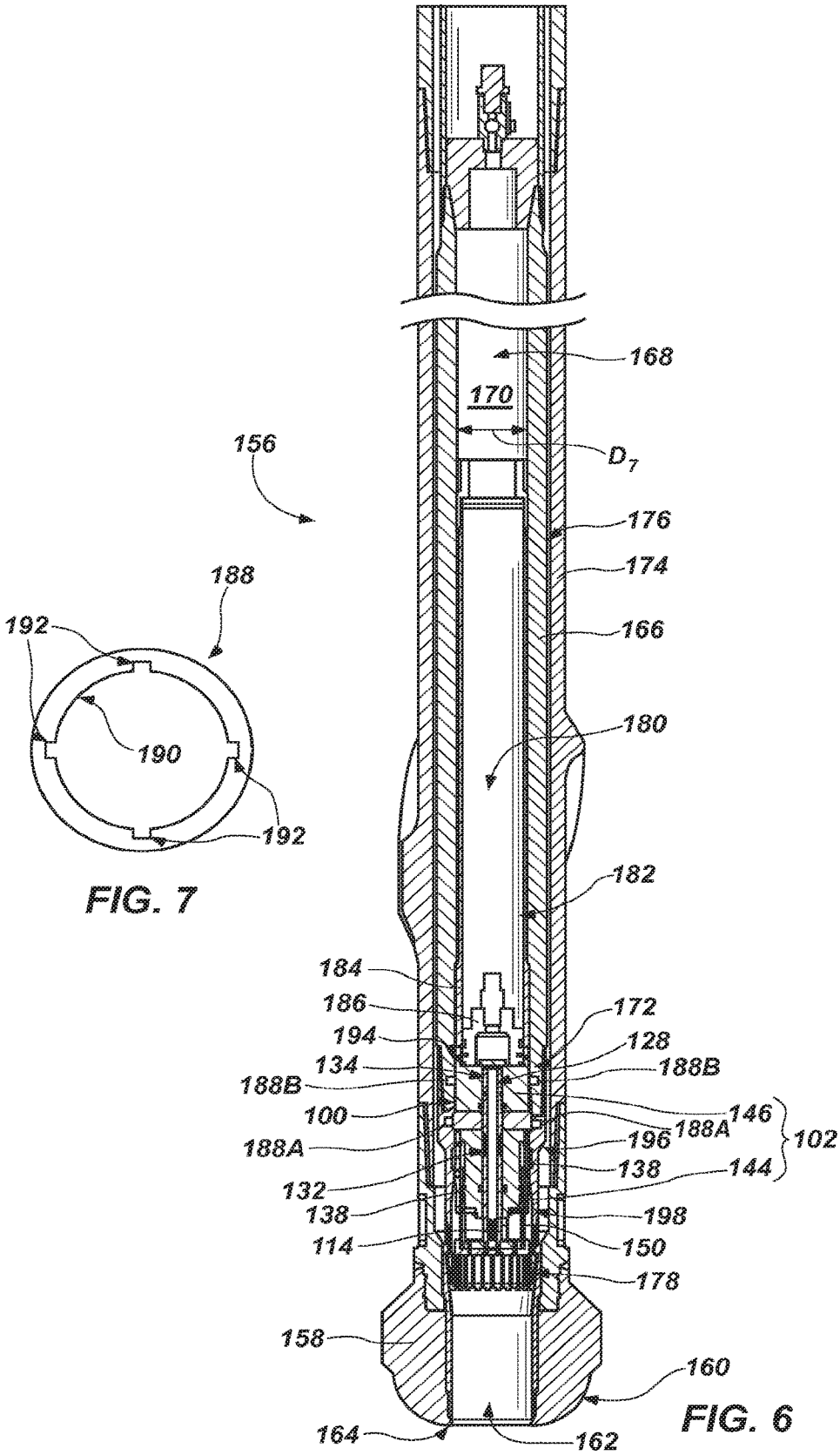
FIG. 6 is a cross-sectional side view of a coring tool including the activation module of FIG. 1 in the first state.
FIG. 7 is an overhead plan view of a wiping element for use with the coring tool of FIG. 6.
Figure 8:
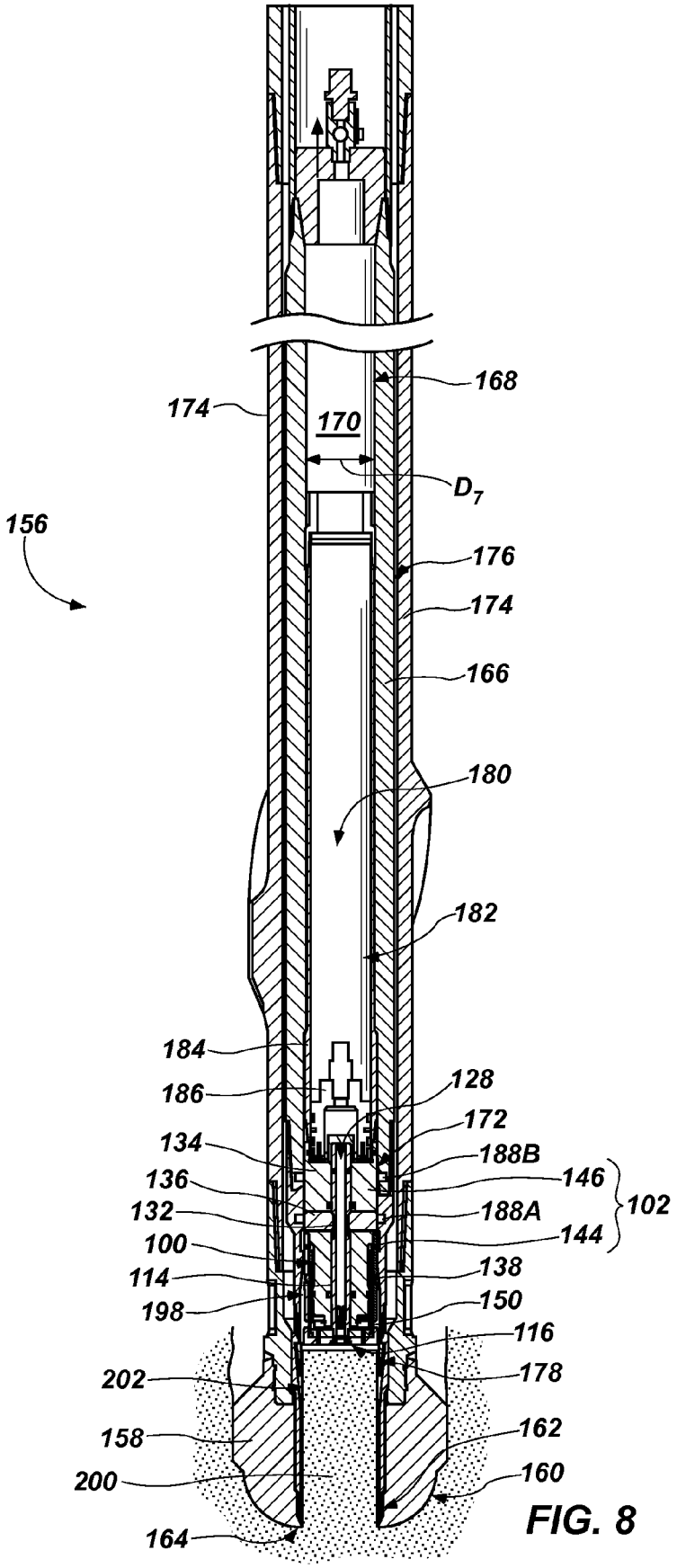
FIG. 8 is a cross-sectional side view of the coring tool of FIG. 6 including the activation module of FIG. 2 in the second state.

The activation rod 114 may be movable between a first position, as shown in FIG. 1, in which the activation module 100 is secured proximate the entrance 172 (see FIGS. 6, 8) to the inner barrel 166 (see FIGS. 6, 8) and a second position (see FIG. 2) in which the activation module 100 is free to enter the inner barrel 166 (see FIGS. 6, 8). For example, the activation rod 114 may include a recessed portion 132 exhibiting a smaller diameter $D_1$ than a diameter $D_2$ of an immediately upper portion 134 of the activation rod 114. When the activation rod 114 is in the first position, as shown in FIG. 1, the upper portion 134 may be aligned with locking members 136, and the recessed portion 132 may be offset from the locking members 136. The locking members 136 may be, for example, resilient blocks of material configured to retain the activation module 100 in place using, for example, frictional resistance as the locking members 136 press against an interior surface 198 (see FIGS. 6, 8) of the coring tool 156 (see FIGS. 6, 8) or mechanical interference as the locking members 136 engage with a shoulder or recess of the coring tool 156. The larger diameter $D_2$ of the upper portion 134 may maintain the locking members 136 engaged with the coring tool 156 (see FIGS. 6, 8) to ensure that the activation module 100 is secured in place proximate the entrance 172 (see FIGS. 6, 8) to the inner barrel 166 (see FIGS. 6, 8) when the activation rod 114 is in the first position.

The activation module 100 may further include a sealing element 138 located at a periphery 140 of the activator body 102. The sealing element 138 may be configured to form a seal between the entrance 172 (see FIGS. 6, 8) to the inner barrel 166 (see FIGS. 6, 8) and an exterior of the inner barrel 166 (see FIGS. 6, 8) when the activation rod 114 is in the first position and to disengage the seal when the activation rod 114 is in the second position (see FIG. 2). The sealing element 138 may be, for example, a resilient, annular member (e.g., an O-ring) configured to form a seal when the activation module 100 is in a first state, as shown in FIG. 1, the seal being disengaged when the activation module 100 is in a second state (see FIG. 2), as described in further detail below.

By positioning the sealing element 138 at the periphery 140 of the activator body 102, as opposed to positioning a sealing element on the interior surface 198 (see FIGS. 6, 8) of the coring tool 156 (see FIGS. 6, 8), the sealing element 138 may not form a seal around a core sample 200 (see FIG. 8) as it advances into the inner barrel 166 (see FIGS. 6, 8).

When a seal is formed around the core sample 200 (see FIG. 8), presaturation fluid 180 (see FIGS. 6, 8) and any other fluid within the inner barrel 166 (see FIGS. 6, 8) is not simply displaced by the advancing core sample 200 (see FIG. 8), but is pressurized and forced into the porous material of the core sample 200 (see FIG. 8). Once a triggering pressure of any pressure-relief valve associated with the inner barrel 166 (see FIGS. 6, 8) is reached, the presaturation fluid 180 (see FIGS. 6, 8) and any other fluid within the inner barrel 166 (see FIGS. 6, 8) may be displaced and exit through the pressure-relief valve, but maintaining the triggering pressure to keep the pressure-relief valve open may force additional fluid into the porous material of the core sample 200 (see FIG. 8). Any fluid entering the porous material of the core sample 200 (see FIG. 8) will likely displace formation fluids (e.g., oil), which may exit the core sample 200 (see FIG. 8 and intermix with drilling fluid circulating through the coring tool 156 (see FIGS. 6, 8)). Replacing naturally occurring fluids within the core sample 200 (see FIG. 8) without capturing those fluids reduces the accuracy with which the core sample 200 (see FIG. 8) including its fluids represents actual characteristics of the earth formation from which the core sample 200 (see FIG. 8) was procured. Accordingly, positioning the sealing element 138 at the periphery of the activation module 100 may increase the fidelity of the characteristics of the core sample 200 (see FIG. 8) to the characteristics of the earth formation.

An accommodation space 142 may be defined within the activator body 102. The accommodation space 142 may be a void, such as, for example, an annular void within the activator body 102 radially adjacent to the periphery 140 of the activator body 102, next to which the sealing element 138 may be located. The accommodation space 142 may enable the sealing element 138 to constrict and disengage a seal responsive to movement of the activation rod 114 from the first position, as shown in FIG. 1, to the second position (see FIG. 2). The accommodation space 142 may be defined, for example, between a first activator body member 144, which may exhibit an annular shape, and a second activator body member 146, which may exhibit a cylindrical shape, the first activator body member 144 surrounding the second activator body member 146. Openings 148 may be defined, for example, in the lower longitudinal end 112 of the activator body 102 and between the sealing element 138 and the locking members 136, granting access to the accommodation space 142 both above and below the sealing element 138.

A seal retainer 150 configured to selectively induce the sealing element 138 to form a seal when the activation module 100 is in the first state of FIG. 1 and disengage the seal when the activation module 100 is in the second state (see FIG. 2) may be attached to, and be movable with, the activation rod 114. The seal retainer 150 may be, for example, an annular member proximate the sealing element 138 within the accommodation space 142, which may be attached to the activation rod 114 by a set of longitudinally extending members extending from the first end 116 of the activation rod 114, through the openings 148 in the lower longitudinal end 112 of the activator body 102, into the accommodation space 142. As another example, the seal retainer 150 may be a tubular member extending from the first end 116 of the activation rod, through an annular opening in the lower longitudinal end 112 of the activator body 102, into the accommodation space 142. The seal retainer 150 may include a first portion 152 having an annular shape and exhibiting a first diameter $D_3$ and a second portion 154 having an annular shape and exhibiting a second, smaller diameter $D_4$. The first portion 152 may be aligned with the sealing element 138, and the second portion 154 may be offset from the sealing element 138, when the activation rod 114 is in the first position shown in FIG. 1. The larger first diameter $D_3$ of the first portion 152 may induce the sealing element 138 to exhibit an increased diameter (e.g., by stretching the sealing element 138 radially outward, inducing a hoop stress within the sealing element 138), causing it to form a seal against an interior surface 198 (see FIGS. 6, 8) of the coring tool 156 (see FIGS. 6, 8). For example, the sealing element 138 may exhibit a first outer diameter $D_5$ when the activation rod 114 is in the first position shown in FIG. 1.

Figure 2:
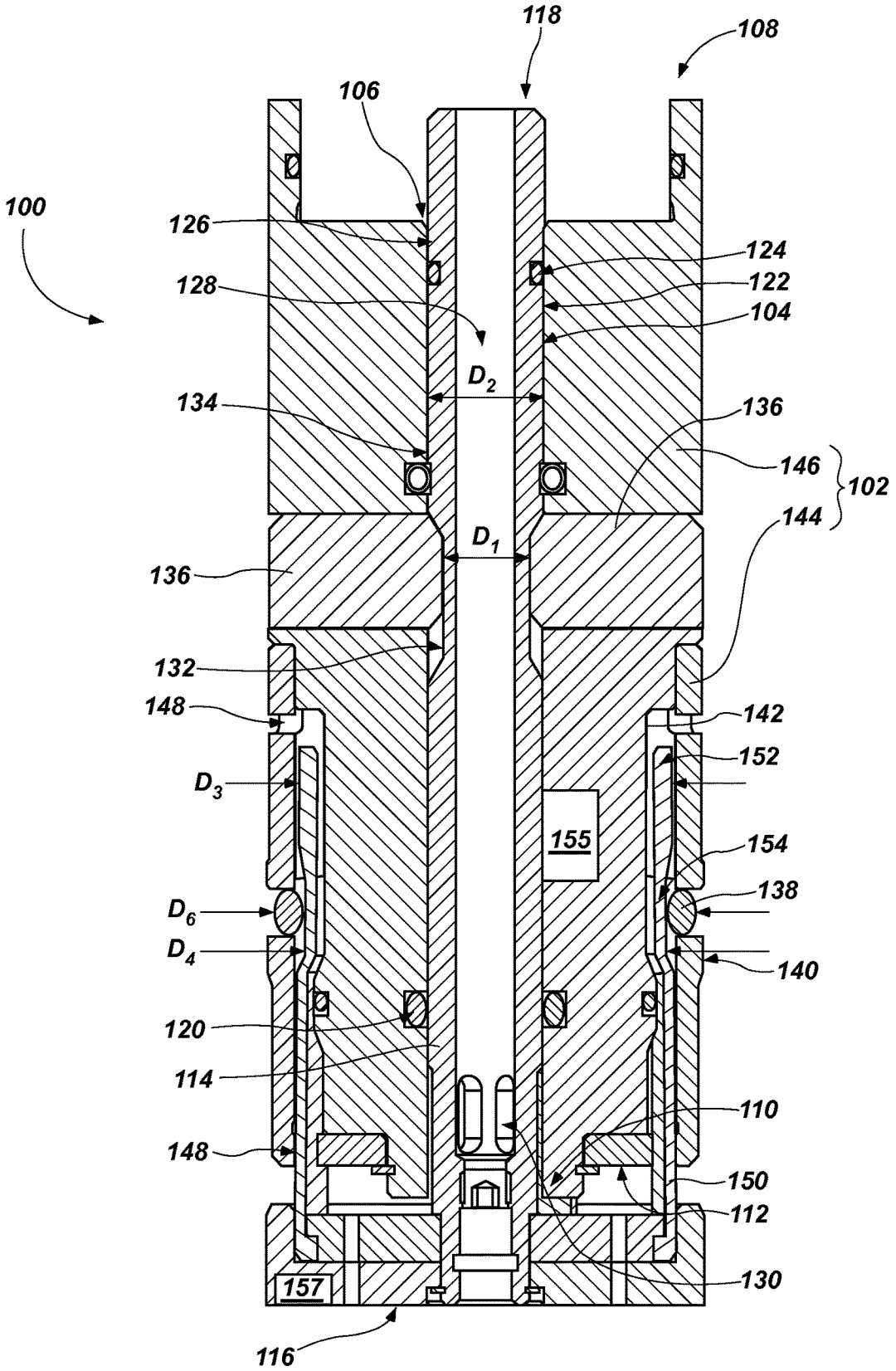
FIG. 2 is a cross-sectional side view of the activation module of FIG. 1 in a second state.

Referring to FIG. 2, a cross-sectional view of the activation module 100 of FIG. 1 is shown in a second state. When in the second state, the activation module 100 may be configured to unobstruct the entrance 172 (see FIGS. 6, 8) to the inner barrel 166 (see FIGS. 6, 8) and may be free to travel into the inner barrel 166 (see FIGS. 6, 8) as a core sample 200 (see FIG. 8) is advanced into the inner barrel 166 (see FIGS. 6, 8). The activation module 100 may automatically transition to the second state responsive to a core sample 200 (see FIG. 8), such as, for example, by forcing the activation rod 114 from the first position to the second position (e.g., by contacting and bearing against the first end 116 of the activation rod 114, advancing toward the inner barrel 166 (see FIGS. 6, 8), and pushing the activation rod 114 longitudinally upward from the first position (see FIG. 1) to the second position shown in FIG. 2). Alternatively or in addition, an actuator 155 (e.g., an electronic, motor-driven linear actuator) may cause the activation module 100 to transition from the first, obstructing state to the second, released state. The actuator 155 may actuate in response to a signal of a sensor 157 (e.g., a proximity or pressure sensor configured to detect an advancing core sample) or a signal sent by an operator (e.g., using mud-pulse telemetry or other downhole signal transmission techniques).

When the activation rod 114 is in the second position, the recessed portion 132 of the activation rod 114 may be aligned with the locking members 136, and the upper portion 134 of the activation rod 114 may be offset from the locking members 136. The smaller diameter $D_1$ of the recessed portion 132 may enable the locking members 136 to move radially inward, disengaging from the interior surface 198 (see FIGS. 6, 8) of the coring tool 156 (see FIGS. 6, 8). When the locking members 136 disengage, the activation module 100 may no longer be secured in place and may be free to ride on the advancing core sample 200 (see FIG. 8) into the inner barrel 166 (see FIGS. 6, 8).

Movement of the activation rod 114 from the first position (see FIG. 1) to the second position shown in FIG. 2 may also cause the seal retainer 150 to move. When the activation rod 114 is in the second position, the second portion 154 of the seal retainer 150 may be aligned with the sealing element 138, and the first portion 152 of the seal retainer 150 may be offset from the sealing element 138. The smaller diameter $D_4$ of the second portion 154 of the seal retainer 150 may enable the sealing element 138 to constrict, reducing its diameter from the first outer diameter $D_5$ to a smaller second outer diameter $D_6$. The reduction in diameter of the sealing element 138 may cause the sealing element 138 to disengage its seal from the interior surface 198 (see FIGS. 6, 8) of the coring tool 156 (see FIGS. 6, 8) and may reduce (e.g., eliminate) the likelihood that the sealing element 138 will interfere with the advancement of the core sample 200 (see FIG. 8), scrape against and damage other components of the coring tool 156 (see FIGS. 6, 8), or otherwise get caught (e.g., by the sponge liner or other equipment that will pass by the sealing element 138 while the activation module 100 rides on top of the advancing core through the coring tool 156 further reducing (e.g., eliminating) the risk of a jam (sometimes referred to as a core jam) within the coring tool 156). The absence of a sealing element configured to form a seal around a core sample 200 (see FIG. 8) as it is received into the inner barrel 166 (see FIGS. 6, 8) may enable presaturation fluid 180 (see FIGS. 6, 8) to exit the inner barrel 166 (see FIGS. 6, 8) through a space between the core sample 200 (see FIG. 8) and adjacent components (e.g., a sponge material 168 (see FIGS. 6, 8) of the coring tool 100 (see FIGS. 6, 8)), rather than displacing formation fluids by exiting through the porous material of the core sample 200 (see FIG. 8).

Figure 3:
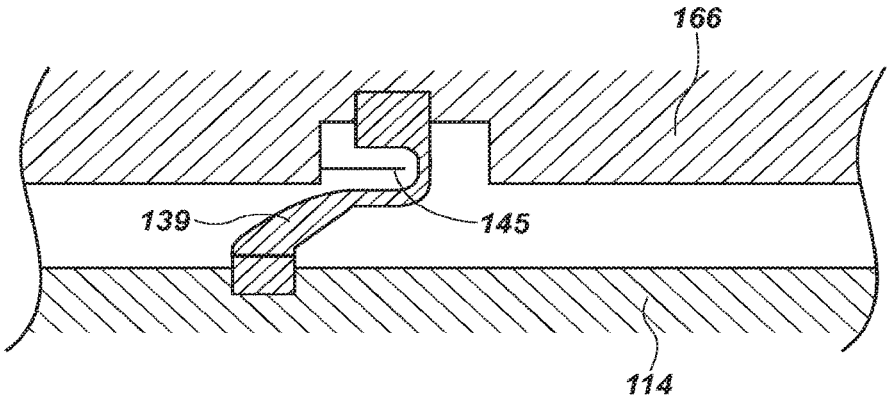
FIG. 3 is a cross-sectional side view of an embodiment of a sealing element for an activation module for a coring tool.

FIG. 3 is a cross-sectional side view of another embodiment of a sealing element 139 for an activation module 100 (see FIGS. 1, 2) for a coring tool 156 (see FIGS. 6, 8). One end of the sealing element 139 may be fixed, for example, to a component that is movable responsive to advancement of a core sample 200 (see FIG. 8), and the other end of the sealing element 139 may be fixed to a component that is at least initially not movable responsive to advancement of the core sample 200 (see FIG. 8). More specifically, one end of the sealing element 139 may be fixed, for example, to an inner barrel 166 or other component of the coring tool 156 (see FIGS. 6, 8) and the other end of the sealing element 139 may be fixed to the activation rod 114. A piercing element 145 may be located proximate the sealing element 139. More specifically, the piercing element 145 may be located on a side of the sealing element 139 opposing the lower longitudinal end 112 (see FIGS. 1, 2) of the activation module 100 (see FIGS. 1, 2). The piercing element 145 may be, for example, a pointed member configured to penetrate the sealing element 139. More specifically, the piercing element 145 may, for example, introduce a tear in the sealing element 139, which may propagate and separate the ends of the sealing element 139 from one another. Accordingly, the seal formed by the sealing element 139 may be disengaged without altering the diameter of the sealing element 139.

Figure 4:
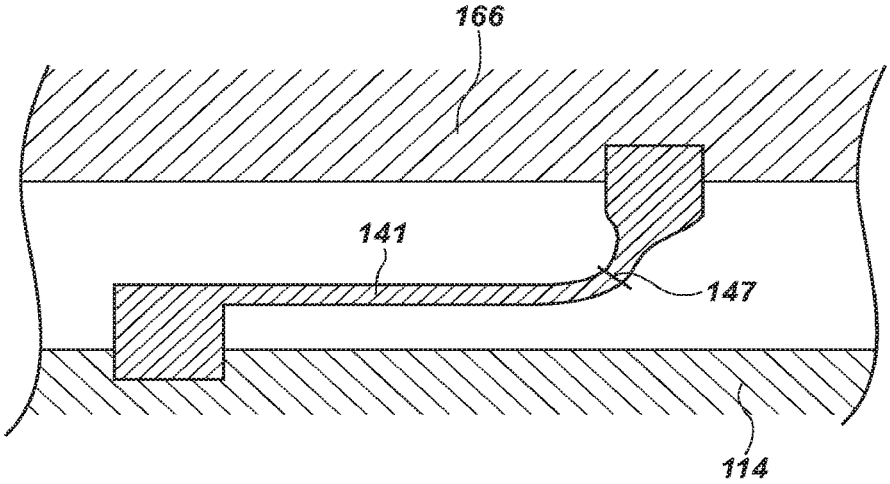
FIG. 4 is a cross-sectional side view of another embodiment of a sealing element for an activation module for a coring tool.

FIG. 4 is a cross-sectional side view of yet another embodiment of a sealing element 141 for an activation module 100 (see FIGS. 1, 2) for a coring tool 156 (see FIGS. 6, 8). The sealing element 141 may be sized and configured to deform and ultimately fail in response to advancement of a core sample 200 (see FIG. 8). For example, the sealing element 141 may be sized, shaped, and of a material such that the sealing element 141 deforms and fails, separating the ends of the sealing element 141 from one another, in response to advancement of a core sample 200 (see FIG. 8). More specifically, the sealing element 141 may include a separation portion 147, which may be designed to fail when it reaches a predetermined stress state. As with the embodiment depicted in FIG. 3, one end of the sealing element 141 shown in FIG. 4 may be fixed, for example, to a component that is movable responsive to advancement of a core sample 200 (see FIG. 8), and the other end of the sealing element 141 may be fixed to a component that is at least initially not movable responsive to advancement of the core sample 200 (see FIG. 8). More specifically, one end of the sealing element 141 may be fixed, for example, to an inner barrel 166 or other component of the coring tool 156 (see FIGS. 6, 8) and the other end of the sealing element 139 may be fixed to the activation rod 114. Such an embodiment may lack any piercing element 145 (see FIG. 3).

Figure 5:
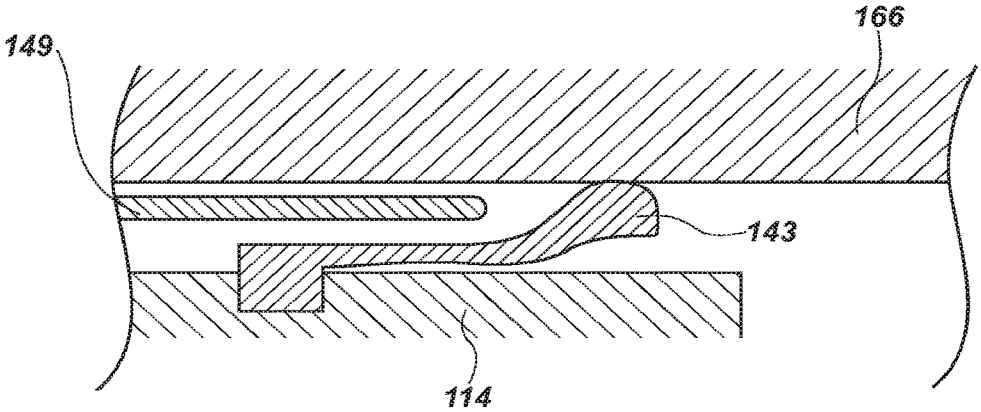
FIG. 5 is a cross-sectional side view of still another embodiment of a sealing element for an activation module for a coring tool.

FIG. 5 is a cross-sectional side view of still another embodiment of a sealing element 143 for an activation module 100 (see FIGS. 1, 2) for a coring tool 156 (see FIGS. 6, 8). One end of the sealing element 143 may be fixed, for example, to a component that is movable responsive to advancement of a core sample 200 (see FIG. 8), and the other end of the sealing element 143 may bear against a component of the coring tool 156 to form the seal. More specifically, one end of the sealing element 143 may be fixed, for example, to the activation rod 114, and the other end of the sealing element 143 may contact and bear against an inner barrel 166 or other component of the coring tool 156 (see FIGS. 6, 8) to form the seal. A separation element 149 may be located proximate the sealing element 143. More specifically, the separation element 149 may be located on a side of the sealing element 143 opposing the lower longitudinal end 112 (see FIGS. 1, 2) of the activation module 100 (see FIGS. 1, 2). The separation element 149 may be configured to disengage the sealing element 143 from the inner barrel 166 or other component of the coring tool 156 (see FIGS. 6, 8) to release the seal. For example, the separation element 149 may be interposed between the activation rod 114 and the inner barrel 166 or other component of the coring tool 156 (see FIGS. 6, 8), such that, as the sealing element 143 moves in response to advancement of a core sample 200 (see FIG. 8), the unattached end of the sealing element 143 contacts the separation element 149 and is forced by the separation element 149 away from the inner barrel 166 or other component of the coring tool 156 (see FIGS. 6, 8).

Referring to FIG. 6, a cross-sectional view of a coring tool 156 including the activation module 100 in the first state of FIG. 1 is shown. The coring tool 156 may include a coring bit 158 at a leading end of the coring tool 156. The coring bit 158 may include a cutting structure 160 configured to cut a core sample 200 (see FIG. 8). The cutting structure 160 may include, for example, cutting elements secured to leading portions of blades extending over a face of the coring bit 158 or abrasive impregnated cutting structures secured to the face of the coring bit 158. The cutting structure 160 may surround a central opening 162 and may define an inner gage 164 at the periphery of the central opening 162. The coring tool 156 may include a core catcher 178 proximate the central opening 162, which may be configured to engage with and secure a core sample 200 (see FIG. 8) such that it is retained by the coring tool 156 and to permit the core sample 200 (see FIG. 8) to advance into the coring tool 156.

The coring tool 156 may further include an inner barrel 166, which may be connected to the coring bit 158 and may be configured to receive a core sample 200 (see FIG. 8) within the inner barrel 166. The inner barrel 166 may be, for example, a generally tube-shaped member of material suitable for downhole use (e.g., a metal, such as, for example, aluminum, tube). The inner barrel 166 may be located longitudinally above the coring bit 158, with an entrance 172 of the inner barrel 166 located at a longitudinally lower end of the inner barrel 166, and may be at least substantially aligned with the central opening 162. The inner barrel 166 may be located within an outer barrel 174 extending longitudinally above the coring bit 158, and a fluid passageway 176 for drilling fluid may be defined between the inner barrel 166 and the outer barrel 174. The activation module 100 may be sized, positioned, and configured to obstruct the entrance 172 when the activation module 100 is in the first state. For example, the sealing element 138 of the activation module 100 may be aligned with or located longitudinally downward from the entrance 172 to the inner barrel 166 to seal the entrance 172 to the inner barrel 166. The inner barrel 166 may be rotatable with respect to the coring bit 158, such that the inner barrel 166 may remain rotationally stationary as it receives a core sample 200 (see FIG. 8) while the coring bit 158 rotates to cut the coring sample.

In some embodiments, the inner barrel 166 may be lined with a sponge material 168, which may be configured to absorb a fluid of interest (e.g., oil) expected to be found within the core sample 200 (see FIG. 8), and may capture the fluid as it escapes from the core sample 200 (see FIG. 8) within the inner barrel 166. The sponge material 168 may define an inner diameter $D_7$ of a bore 170 into which the core sample 200 (see FIG. 8) may be received. A structure of the sponge material 168 may be, for example, a porous body characterized by an open network of pores into which fluid may infiltrate. The sponge material 168 may be, for example, a foam (e.g., a polyurethane foam), coating, felt, or any other material into which fluids may infiltrate (e.g., using capillary action to draw the fluid into the material). The sponge material 168 may be selected from a group of materials having a wettability that is higher with respect to a fluid of interest compared to other fluids. For example, the sponge material may be selected from a group of materials, which may be preferentially wetted by oil. In embodiments where the sponge material 168 exhibits preferential wettability (i.e., more easily absorbs a selected fluid), the sampling of fluids within the sponge material 168 after procuring a core sample may more accurately reflect the concentration of a particular fluid of interest (e.g., oil). The sponge material 168 may be provided, for example, in sections that are individually inserted into the inner barrel 166 and attached to the inner barrel 166 adjacent to one another until they line an entire longitudinal length of the inner barrel 166 above a selected point.

A presaturation fluid 180 may be located within the inner barrel 166 when the activation module 100 is in the first state. The presaturation fluid 180 may be, for example, a fluid of known composition that will not contaminate the core sample 200 (see FIG. 8) (e.g., a brine solution). Presaturation fluid 180 may be introduced into the inner barrel 166 by, for example, producing a partial vacuum within the inner barrel 166, which may remove at least some of the fluid (e.g., gas, such as air) from the interior of the inner barrel 166. Optionally, the inner barrel 166 or the sponge material 168 may be flushed before the creation of the partial vacuum with a suitable fluid, such as, but not limited to, brine or gas (e.g. air). The presaturation fluid 180 may then be flowed into the inner barrel 166, and the interior of the inner barrel 166 may be pressurized with the presaturation fluid 180. After pressurization with presaturation fluid 180, the inner barrel 166 may contain a mixture of presaturation fluid 180 and a rest fluid (e.g., fluid or gas, such as air) that was not completely removed during creation of the partial vacuum. The activation module 100, and particularly the sealing element 138 of the activation module, which may be engaged with an interior surface 198 of the coring tool 156, may seal or at least contribute to sealing the presaturation fluid 180 and any other fluids within the interior of the inner barrel 166, while reducing (e.g., eliminating) the likelihood that exterior fluids (e.g., circulating drilling fluid) will enter the inner barrel 166 and contaminate the interior of the inner barrel 166.

In some embodiments, the coring tool 100 may include a compensation module 182 configured to compensate for pressure differentials between the interior and the exterior of the inner barrel 166. The compensation module 182 may be at least substantially as described in U.S. Provisional Patent Application No. 61/847,915, filed Jul. 18, 2013, for "PRESSURE COMPENSATION MODULES FOR CORING TOOLS, CORING TOOLS INCLUDING PRESSURE COMPENSATION MODULES, AND RELATED METHODS," the disclosure of which is incorporated in this application in its entirety by this reference. Briefly, the compensation module 182 may include a compensator housing 184 located within the bore 170 of the inner barrel 166 and a compensating piston 186 located within the compensator housing 184. The compensating piston 186 may form a seal, such that the presaturation fluid 180 and any other fluids sealed within the inner barrel 166 are located on one side of the compensating piston 186 and circulating drilling fluid is located on the other side of the compensating piston 186. In this way, the compensation module 182 and the activation module 100 may cooperatively seal the interior of the inner barrel 166 from the exterior of the inner barrel 166 such that drilling fluid does not intermix with presaturation fluid 180 within the inner barrel 166. As fluids within the inner barrel 166 expand and contract responsive to changes in pressure differentials between the interior and the exterior of the inner barrel 166, the compensating piston 186 may travel along the length of the compensator housing 184 to expand and contract the volume occupiable by the fluids within the inner barrel 166. The compensating piston 186 may be exposed to the pressure of the circulating drilling fluid by, for example, the compensation bore 128 extending through the activation rod 114 of the activation module 100, which may be located longitudinally downward from, and may be attached to, the compensation module 182.

In some embodiments, and with continued reference to FIG. 6, the coring tool 156 may include at least one wiping element 188 configured to wipe fluids (e.g., drilling fluid) from an outer surface 202 (see FIG. 8) of a core sample 200 (see FIG. 8) as it advances into the inner barrel 166. For example, the coring tool 156 may include a first wiping element 188A and a second wiping element 188B, each of which may be located proximate, and longitudinally downward from, the entrance 172 to the inner barrel 166. The wiping elements 188A and 188B may be configured not to form a seal around the core sample 200 (see FIG. 8) as it advances into the inner barrel 166.

Referring to FIG. 7, an overhead plan view of a wiping element 188, representative of the wiping elements 188A and 188B of the coring tool of FIG. 6, is shown. Each wiping element 188 may include a discontinuous wiping edge 190 made of an elastic material configured to contact the outer surface 202 (see FIG. 8) of the core sample 200 (see FIG. 8) and wipe fluids off the outer surface 202 (see FIG. 8) as the core sample 200 (see FIG. 8) advances into the inner barrel 166. Each wiping element 188 may further include at least one slot 192, each slot 192 forming a discontinuity configured to permit presaturation fluid 180 and other fluids from within the inner barrel 166 to flow from one side 194 of the wiping element 188 to another side 196 of the wiping element 188, which may reduce (e.g., eliminate) the likelihood that drilling fluid traveling with the advancing core into the inner barrel 166 will thereby contaminate the sponge material 168, the presaturation fluid 180, or the formation fluid escaping from the core sample 200 (see FIG. 8). Referring collectively to FIGS. 6 and 7, in embodiments where the coring tool 156 includes multiple wiping elements 188A and 188B, the slots 192 of the wiping elements 188A and 188B may be offset from one another, such as, for example by positioning the slots 192 at different azimuthal locations around the circumferences of the wiping elements 188A and 188B (e.g., by rotating one of the wiping elements 188A between about 15° and about 30°, such as about 22.5° with respect to the other wiping element 188B). Offsetting the slots 192 may enable the second wiping element 188B to wipe fluids that may have passed through the slots 192 of the first wiping element 188A, reducing (e.g., eliminating) the likelihood that fluids from outside the inner barrel 166, which are not located within the porous structure of the core sample 200 (see FIG. 8), will enter and contaminate the inner barrel 166.

Referring to FIG. 8, a cross-sectional view of the coring tool 156 of FIG. 6 including the activation module 100 in the second state of FIG. 2 is shown. The coring tool 156 may be placed in a wellbore and, when the coring bit 158 reaches the bottom of the wellbore, the coring bit 158 may be rotated to cut a core sample 200 from the underlying earth formation. As the core sample 200 advances into the central opening 162, it may exert a force on the first end 116 of the activation rod 114 that pushes the activation rod 114 from the first position (see FIGS. 1, 3) to the second position shown in FIGS. 2 and 5. Alternatively, a signal may be created by a sensor 157 (see FIGS. 1, 2) in response to sensing the movement of the core sample 200 with respect to the coring tool 156. The signal may cause an actuator 155 (see FIGS. 1, 2) to actuate to move the activation rod 114 from the first position to the second position.

Responsive to the activation rod 114 moving from the first position to the second position, the recessed portion 132 of the activation rod 114 may align with the locking members 136, the upper portion 134 having become offset from the locking members 136. The locking members 136 may then be free to move radially inward and disengage from the interior surface 198 of the coring tool 156. When the locking members 136 disengage, the activation module 100, and the compensation module 182 attached to the activation module 100, may be free to ride on the advancing core sample 200 and enter the inner barrel 166.

When the activation rod 114 moves from the first position to the second position, the second portion 154 (see FIGS. 1, 2) of the seal retainer 150 may align with the sealing element 138, the first portion 152 (see FIGS. 1, 2) of the seal retainer 150 having become offset from the sealing element 138. The sealing element 138 may contract, reducing its diameter $D_6$ (see FIG. 2). The smaller diameter $D_6$ of the sealing element 138 may be less than the diameter $D_7$ (see FIGS. 6, 8) of the sponge material 168, such that the sealing element 138 does not scrape against and potentially damage the sponge material 168 as the activation module 100 passes into and along the inner barrel 166.

As the core sample 200 advances past the wiping elements 188A and 188B, the discontinuous wiping edges 190 (see FIG. 7) may contact the outer surface 202 of the core sample. The wiping elements 188A and 188B may wipe fluid from the outer surface 202 of the core sample 200 to reduce (e.g., eliminate) the likelihood that contaminants (e.g., drilling fluid) will enter the inner barrel along with the core sample 200. Advancement of the core sample 200 into the inner barrel 166 may also displace presaturation fluid 180 and any other fluid within the inner barrel 166, which may cause at least some of the presaturation fluid 180 and any other fluid within the inner barrel 166 to flow through the slots 192 in the wiping elements 188A and 188B, past the entrance 172 to the inner barrel 166, and into the circulating drilling fluid.

Additional, nonlimiting, illustrative embodiments encompassed by this disclosure include:

Embodiment 1

Activation modules for selectively sealing entrances to inner barrels of coring tools may include: an activator body sized and configured to obstruct the entrance to the inner barrel when the activation module is in a first state and to release the entrance to the inner barrel when the activation module is in a second state; and a sealing element located at a periphery of the activator body, the sealing element being configured to form a seal between at least a portion of an interior of the inner barrel and at least a portion of an exterior of the inner barrel when the activation module is in the first state and to disengage the seal when the activation module is in the second state.

Embodiment 2

The activation module of Embodiment 1, further comprising an activation rod located at least partially within the activator body, the activation rod being movable between a first position in which the activation module is in the first state and a second position in which the activation module is in the second state.

Embodiment 3

The activation module of Embodiment 2, wherein the activation rod comprises a seal retainer comprising a first portion exhibiting a first outer diameter and a second portion exhibiting a second, smaller outer diameter, the first portion being aligned with the sealing element when the activation rod is in the first position and the second portion being aligned with the sealing element when the activation rod is in the second position.

Embodiment 4

The activation module of any one of Embodiments 1 through 3, wherein the activation module comprises an opening extending at least partially through the activation module, the opening being configured to provide fluid communication between a first end and a second, opposing end of the activation rod.

Embodiment 5

The activation module of any one of Embodiments 1 through 4, further comprising an actuator configured to transition the activation module from the first state to the second state in response to a signal.

Embodiment 6

Coring tools may include: a coring bit comprising a cutting structure configured to cut a core sample; an inner barrel connected to the coring bit, the inner barrel being configured to receive a core sample within the inner barrel; and an activation module configured to selectively seal an entrance to the inner barrel, the activation module comprising: an activator body sized and configured to obstruct the entrance to the inner barrel when the activation module is in a first state and to release the entrance to the inner barrel when the activation module is in a second state; and a sealing element located at a periphery of the activator body, the sealing element being configured to form a seal between at least a portion of an interior of the inner barrel and at least a portion of an exterior of the inner barrel when the activation module is in the first state and to disengage the seal when the activation module is in the second state.

Embodiment 7

The coring tool of Embodiment 6, further comprising: an activation rod located at least partially within the activator body, the activation rod being movable between a first position in which the activation module is in a first state and a second position in which the activation module is in a second state.

Embodiment 8

The coring tool of Embodiment 7, wherein the activation rod comprises a seal retainer comprising a first portion exhibiting a first outer diameter and a second portion exhibiting a second, smaller outer diameter, the first portion being aligned with the sealing element when the activation rod is in the first position and the second portion being aligned with the sealing element when the activation rod is in the second position.

Embodiment 9

The coring tool of Embodiment 8, wherein the activation module is configured to transition from the first state to the second state in response to a core approaching the activation module.

Embodiment 10

The coring tool of Embodiment 9, further comprising: a sensor configured to sense a location of a core sample; and an actuator configured to transition the activation module from the first state to the second state in response to a signal from the sensor.

Embodiment 11

The coring tool of Embodiment 9, wherein the activation module is configured to transition from the first state to the second state in response to a force on the seal retainer, the force being generated at least partially by an approaching core sample.

Embodiment 12

The coring tool of any one of Embodiments 6 through 11, wherein the sealing element exhibits a first outer diameter when the activation rod is in the first position and a second, smaller outer diameter when the activation rod is in the second position.

Embodiment 13

The coring tool of Embodiment 12, wherein the second, smaller diameter of the sealing element is less than an inner diameter of a sponge material lining the inner barrel.

Embodiment 14

The coring tool of any one of Embodiments 6 through 13, further comprising a wiping element located proximate the entrance to the inner barrel, the wiping element being sized and configured to wipe fluids from an outer surface of a core sample, the wiping element being configured not to form a seal around the core sample.

Embodiment 15

The coring tool of Embodiment 14, wherein the wiping element comprises a discontinuous wiping edge configured to contact the outer surface of the core sample and at least one slot forming a discontinuity in the wiping edge, the at least one slot being configured to permit presaturation fluid to flow from one side of the wiping element to another side of the wiping element.

Embodiment 16

The coring tool of Embodiment 15, further comprising another wiping element located proximate the entrance to the inner barrel, the other wiping element comprising another discontinuous wiping edge and at least another slot, the at least another slot being offset from the at least one slot.

Embodiment 17

The coring tool of any one of Embodiments 6 through 16, wherein the activation module comprises an opening extending at least partially through the activation module, the opening being configured to provide fluid communication between the first end and the second, opposing end of the activation module.

Embodiment 18

Methods of coring earth formations may involve: advancing a coring tool into a wellbore, the coring tool comprising an inner barrel configured to receive a core sample cut by the coring tool, the inner barrel comprising a presaturation fluid; flowing drilling fluid along an exterior of the inner barrel; sealing the presaturation fluid within at least a portion of the inner barrel and sealing the drilling fluid from intermixing with the presaturation fluid utilizing an activation module, the activation module comprising a sealing element located at a periphery of an activator body of the activation module; cutting a core sample utilizing the coring tool, advancing the core sample toward the inner barrel; and responsive to the core sample advancement, transferring the activation module from a first state to a second state in which the activation module is free to enter the inner barrel and the seal previously formed by the sealing element is disengaged.

Embodiment 19

The method of Embodiment 18, further comprising: sensing a location of the advancing core sample utilizing a sensor; and transferring the activation module from the first state to the second state utilizing an actuator in response to a signal from the sensor.

Embodiment 20

The method of Embodiment 18 or Embodiment 19, wherein disengaging the seal comprises moving a seal retainer to misalign a first portion of the seal retainer exhibiting a first outer diameter from the sealing element and aligning a second portion of the seal retainer exhibiting a second, smaller outer diameter with the sealing element.

Embodiment 21

The method of any one of Embodiments 18 through 20, wherein disengaging the seal comprises contracting the sealing element to reduce an outer diameter of the sealing element.

Embodiment 22

The method of Embodiment 21, wherein contracting the sealing element to reduce the diameter of the sealing element comprises reducing the diameter of the sealing element to be less than an inner diameter of a sponge material lining the inner barrel.

Embodiment 23

The method of any one of Embodiments 18 through 22, further comprising wiping drilling fluid from an outer surface of the core sample utilizing a wiping element located proximate the entrance to the inner barrel and refraining from forming a seal around the core sample utilizing the wiping element.

Embodiment 24

The method of Embodiment 23, wherein refraining from forming the seal around the core sample utilizing the wiping element comprises permitting presaturation fluid to flow through at least one slot forming a discontinuity in a discontinuous wiping edge of the wiping element from one side of the wiping element to another side of the wiping element.

Embodiment 25

The method of Embodiment 24, further comprising wiping additional drilling fluid from the outer surface of the core sample utilizing another wiping element located proximate an entrance to the inner barrel and refraining from forming a seal around the core sample utilizing the other wiping element.

Embodiment 26

The method of Embodiment 25, wherein refraining from forming the seal around the core sample utilizing the other wiping element comprises permitting presaturation fluid to flow through at least another slot in another discontinuous wiping edge of the other wiping element from one side of the other wiping element to another side of the other wiping element, the at least another slot being offset from the at least one slot.

Embodiment 27

The method of any one of Embodiments 18 through 26, further comprising flowing fluid through an opening extending at least partially through the activation module, the fluid being permitted to flow between a first end and a second, opposing end of the activation module.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may be made to produce embodiments within the scope of this disclosure, such as those hereinafter claimed, including legal equivalents. In addition, features from one disclosed embodiment may be combined with features of another disclosed embodiment while still being within the scope of this disclosure, as contemplated by the inventors.

What is claimed is:

1. An activation module for selectively sealing an entrance to an inner barrel of a coring tool, comprising:

an activator body sized and configured to obstruct the entrance to the inner barrel when the activation module is in a first state and to release the entrance to the inner barrel when the activation module is in a second state;

an activation rod located at least partially within the activator body, the activation rod being movable between a first position in which the activation module is in the first state and a second position in which the activation module is in the second state; and a sealing element located at a periphery of the activator body, the sealing element being configured to form a seal between at least a portion of an interior of the inner barrel and at least a portion of an exterior of the inner barrel when the activation module is in the first state and to disengage the seal when the activation module is in the second state;

wherein the activation rod comprises a seal retainer comprising a first portion exhibiting a first outer diameter and a second portion exhibiting a second, smaller outer diameter, the first portion being aligned with the sealing element when the activation rod is in the first position and the second portion being aligned with the sealing element when the activation rod is in the second position.

2. The activation module of claim 1, wherein the activation module comprises an opening extending at least partially through the activation module, the opening being configured to provide fluid communication between a first end and a second, opposing end of the activation rod.

3. The activation module of claim 1, further comprising an actuator configured to transition the activation module from the first state to the second state in response to a signal.

4. A coring tool, comprising:

a coring bit comprising a cutting structure configured to cut a core sample;

an inner barrel connected to the coring bit, the inner barrel being configured to receive a core sample within the inner barrel; and an activation module configured to selectively seal an entrance to the inner barrel, the activation module comprising:

an activator body sized and configured to obstruct the entrance to the inner barrel when the activation module is in a first state and to release the entrance to the inner barrel when the activation module is in a second state;

an activation rod located at least partially within the activator body, the activation rod being movable between a first position in which the activation module is in a first state and a second position in which the activation module is in a second state; and a sealing element located at a periphery of the activator body, the sealing element being configured to form a seal between at least a portion of an interior of the inner barrel and at least a portion of an exterior of the inner barrel when the activation module is in the first state and to disengage the seal when the activation module is in the second state;

wherein the activation rod comprises a seal retainer comprising a first portion exhibiting a first outer diameter and a second portion exhibiting a second, smaller outer diameter, the first portion being aligned with the sealing element when the activation rod is in the first position and the second portion being aligned with the sealing element when the activation rod is in the second position.

5. The coring tool of claim 4, wherein the activation module is configured to transition from the first state to the second state in response to a core approaching the activation module.

6. The coring tool of claim 5, further comprising:

a sensor configured to sense a location of a core sample; and an actuator configured to transition the activation module from the first state to the second state in response to a signal from the sensor.

7. The coring tool of claim 5, wherein the activation module is configured to transition from the first state to the second state in response to a force on the seal retainer, the force being generated at least partially by an approaching core sample.

8. The coring tool of claim 4, wherein the sealing element exhibits a first outer diameter when the activation rod is in the first position and a second, smaller outer diameter when the activation rod is in the second position.

9. The coring tool of claim 4, further comprising a wiping element located proximate the entrance to the inner barrel, the wiping element being sized and configured to wipe fluids from an outer surface of a core sample, the wiping element being configured not to form a seal around the core sample.

10. The coring tool of claim 4, wherein the activation module comprises an opening extending at least partially through the activation module, the opening being configured to provide fluid communication between a first end and a second, opposing end of the activation module.

11. A method of coring an earth formation, comprising:

advancing a coring tool into a wellbore, the coring tool comprising an inner barrel configured to receive a core sample cut by the coring tool, the inner barrel comprising a presaturation fluid;

flowing drilling fluid along an exterior of the inner barrel;

sealing the presaturation fluid within at least a portion of the inner barrel and sealing the drilling fluid from intermixing with the presaturation fluid utilizing an activation module, the activation module comprising a sealing element located at a periphery of an activator body of the activation module;

cutting a core sample utilizing the coring tool, advancing the core sample toward the inner barrel; and responsive to the core sample advancement, transferring the activation module from a first state to a second state in which the activation module is free to enter the inner barrel and the seal previously formed by the sealing element is disengaged by moving a seal retainer to misalign a first portion of the seal retainer exhibiting a first outer diameter from the sealing element and aligning a second portion of the seal retainer exhibiting a second, smaller outer diameter with the sealing element or by contracting the sealing element to reduce an outer diameter of the sealing element.

12. The method of claim 11, further comprising:

sensing a location of the advancing core sample utilizing a sensor; and transferring the activation module from the first state to the second state utilizing an actuator in response to a signal from the sensor.

13. The method of claim 11, further comprising wiping drilling fluid from an outer surface of the core sample utilizing a wiping element located proximate an entrance to the inner barrel and refraining from forming a seal around the core sample utilizing the wiping element.

14. The method of claim 11, further comprising flowing fluid through an opening extending at least partially through the activation module, the fluid being permitted to flow between a first end and a second, opposing end of the activation module.

* * * * *